US011639817B2

(12) United States Patent
Zhuo et al.

(10) Patent No.: US 11,639,817 B2
(45) Date of Patent: May 2, 2023

(54) HEAT EXCHANGER, AIR CONDITIONER, AND REFRIGERATING UNIT

(71) Applicant: GREE ELECTRIC APPLIANCES, INC. OF ZHUHAI, Zhuhai (CN)

(72) Inventors: Mingsheng Zhuo, Zhuhai (CN); Peisheng Chen, Zhuhai (CN); Puzhong Wang, Zhuhai (CN); Yang Liu, Zhuhai (CN); Jiankai Wang, Zhuhai (CN); Qi Cheng, Zhuhai (CN); Hongle Huang, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 263 days.

(21) Appl. No.: 16/961,697

(22) PCT Filed: Dec. 11, 2018

(86) PCT No.: PCT/CN2018/120269
§ 371 (c)(1),
(2) Date: Jul. 13, 2020

(87) PCT Pub. No.: WO2019/141022
PCT Pub. Date: Jul. 25, 2019

(65) Prior Publication Data

US 2021/0080158 A1 Mar. 18, 2021

(30) Foreign Application Priority Data

Jan. 17, 2018 (CN) ..... 201810045147.0

(51) Int. Cl.
*F28D 3/02* (2006.01)
*F28D 3/04* (2006.01)
(Continued)

(52) U.S. Cl.
CPC ..... *F25B 39/00* (2013.01); *F28F 17/005* (2013.01); *F28D 1/05316* (2013.01);
(Continued)

(58) Field of Classification Search
CPC ..... F28F 25/00; F28F 2025/005; F28F 25/02; F28F 25/04; F28F 17/005; F28F 9/007;
(Continued)

(56) References Cited

U.S. PATENT DOCUMENTS 4,235,281 A * 11/1980 Fitch ..... B01D 1/28 165/905
4,616,698 A * 10/1986 Klaren ..... F28D 13/00 165/115
(Continued)

FOREIGN PATENT DOCUMENTS

CN 202350567 U 7/2012
CN 203629146 U 6/2014
(Continued)

*Primary Examiner* — Frantz F Jules
*Assistant Examiner* — Jason N Thompson
(74) *Attorney, Agent, or Firm* — Kilpatrick Townsend & Stockton, LLP

(57) ABSTRACT

A heat exchanger includes a heat exchange tube (10) and a first water collecting tank (20). The first water collecting tank (20) is provided on the heat exchange tube (10), a first water diversion hole (21) is provided at a bottom portion of the first water collecting tank (20), the heat exchange tube (10) passes through the first water diversion hole (21), and the first water diversion hole (21) has a diameter greater than an outer diameter of the heat exchange tube (10). By providing the first water collecting tank (20), and making the heat exchange tube (10) pass through the first water diversion hole (21) provided on the first water collecting tank (20), and leaving a gap between the heat exchange tube (10) and the first water diversion hole (21), the water in the first
(Continued)

water collecting tank (20) evenly flows into the first water diversion hole (21).

8 Claims, 2 Drawing Sheets

(51) Int. Cl.

| | |
|---|---|
| ***F28D 5/02*** | (2006.01) |
| ***F28F 25/00*** | (2006.01) |
| ***F28F 25/02*** | (2006.01) |
| ***F28F 25/04*** | (2006.01) |
| ***F25B 39/00*** | (2006.01) |
| ***F28F 17/00*** | (2006.01) |
| *F28D 1/053* | (2006.01) |
| *F28D 21/00* | (2006.01) |
| *F28F 9/02* | (2006.01) |

(52) U.S. Cl.
CPC ..... *F28D 2021/0084* (2013.01); *F28D 2021/0085* (2013.01); *F28F 9/0275* (2013.01)

(58) Field of Classification Search
CPC .. F28F 9/0131; F28D 3/02; F28D 3/04; F28D 5/02
USPC ..... 165/115; 261/153
See application file for complete search history.

(56) References Cited

U.S. PATENT DOCUMENTS

| | | | | |
|---|---|---|---|---|
| 5,020,587 | A * | 6/1991 | Mongia | F28F 9/0131 165/DIG. 65 |
| 5,893,410 | A * | 4/1999 | Halbrook | F28D 3/02 261/153 |
| 6,435,484 | B1 * | 8/2002 | Uehara | F28D 3/02 261/153 |
| 2004/0007349 | A1 | 1/2004 | Youn et al. | |
| 2004/0050537 | A1 * | 3/2004 | Kim | F28F 1/022 165/914 |
| 2008/0121384 | A1 * | 5/2008 | Tseng | F28F 9/001 165/149 |

FOREIGN PATENT DOCUMENTS

| | | | |
|---|---|---|---|
| CN | 205014697 | U | 2/2016 |
| CN | 108168150 | A | 6/2018 |
| CN | 208012163 | U | 10/2018 |
| JP | 58062494 | A | 4/1983 |
| JP | 1082590 | A | 3/1998 |

* cited by examiner

HEAT EXCHANGER, AIR CONDITIONER, AND REFRIGERATING UNIT

CROSS REFERENCES TO RELATED APPLICATION

This patent application is a National Stage of International Application No. PCT/CN2018/120269, filed on Dec. 11, 2018, which claims priority to Chinese patent application 201810045147.0, filed on Jan. 17, 2018, entitled "Heat Exchanger, Air Conditioner, and Refrigerating Unit", the content of which are hereby incorporated by reference in their entireties.

FIELD

The present disclosure relates to the field of air conditioning technology, and particularly to a heat exchanger, an air conditioner and a refrigerating unit.

BACKGROUND

At present, the rail transportation industry is developing rapidly, and the demand for air conditioner in the rail transportation industry is increased sharply. Refrigerating units can meet the demand for air conditioner in the rail transportation industry. A condenser and an evaporator, as important parts of a refrigerating unit, are research focuses of various manufacturers. Since the lengths of the heat exchange tubes are generally longer, a situation of uneven water distribution in pipelines is easy to occur, resulting in a lower heat exchange efficiency.

SUMMARY

Embodiments of the present disclosure provide a heat exchanger, an air conditioner and a refrigerating unit, which solve the problem of uneven water diversion of the heat exchange tubes of the heat exchanger.

According to embodiments of the present disclosure, a heat exchanger is provided. The heat exchanger includes a heat exchange tube and a first water collecting tank, the first water collecting tank is provided on the heat exchange tube, a first water diversion hole is provided at a bottom portion of the first water collecting tank, the heat exchange tube passes through the first water diversion hole, and the first water diversion hole has a diameter greater than an outer diameter of the heat exchange tube.

In an embodiment, the heat exchanger further includes an upper side plate, the upper side plate is located above the first water collecting tank, a mounting hole is provided on the upper side plate, and the heat exchange tube is fixedly mounted in the mounting hole.

In an embodiment, a drainage structure is further provided on the upper side plate, and water flows through the drainage structure into the first water collecting tank.

In an embodiment, the drainage structure has a plurality of drainage holes.

In an embodiment, the drainage holes are provided on the upper side plate at intervals, and one drainage hole is provided between every two adjacent mounting holes.

In an embodiment, the heat exchanger further includes a lower side plate, the lower side plate is located below the first water collecting tank, a second connection hole is provided on the lower side plate, and the heat exchange tube is fixedly mounted in the second connection hole.

In an embodiment, the heat exchanger further includes a connection plate, the connection plate is provided between the upper side plate and the lower side plate, and two ends of the connection plate are respectively fixed to the upper side plate and the lower side plate.

In an embodiment, the heat exchanger further includes a second water collecting tank, the second water collecting tank is provided on the heat exchange tube and is located above the first water collecting tank, a second water diversion hole is further provided on the second water collecting tank, and water flows through the second water diversion hole into the first water collecting tank.

In an embodiment, the heat exchange tube passes through the second water diversion hole, and the second water diversion hole has a diameter greater than an outer diameter of the heat exchange tube.

In an embodiment, a center of the second water diversion hole is located on an axis of the heat exchange tube.

In an embodiment, the heat exchanger includes the upper side plate, the second water collecting tank is located below the upper side plate, and the heat exchange tube expanding to the upper side plate passes through the second water collecting tank.

In an embodiment, the heat exchanger includes the connection plate, the upper side plate covers the second water collecting tank, the first water collecting tank is fixed to the connection plate, and the second water collecting tank is fixed to the connection plate.

In an embodiment, a center of the first water diversion hole is located on an axis of the heat exchange tube.

In an embodiment, the heat exchanger further includes a liquid collecting tube and a gas diversion tube, one end of the heat exchange tube is connected to the gas diversion tube, and the other end of the heat exchange tube is connected to the liquid collecting tube.

In another embodiment of the present disclosure, an air conditioner including the above-mentioned heat exchanger is provided.

In another embodiment of the present disclosure, a refrigerating unit including the above-mentioned heat exchanger is provided.

In the present disclosure, by providing the first water collecting tank, and making the heat exchange tube pass through the first water diversion hole provided on the first water collecting tank, and leaving a gap between the heat exchange tube and the first water diversion hole, the water in the first water collecting tank evenly flows into the first water diversion hole. Since the gap is smaller, the water flow can pass through the gap, and then can adhere to the heat exchange tube in the first water diversion hole after the water flow passes through the gap, which is beneficial to forming a water film on an outer surface of the heat exchange tube, improving the heat exchange efficiency.

The reference signs in FIGS. 1 to 6 respectively represent: 10, heat exchange tube; 20, first water collecting tank; 21, first water diversion hole; 31, second water collecting tank; 312, second water diversion hole; 32, lower side plate; 321, second connection hole; 33, connection plate; 34, upper side plate; 341, drainage hole; 342, mounting hole.

DETAILED DESCRIPTION

The present disclosure will be further described below in combination with the embodiments. However the present disclosure is not limited to the contents of the description.

Figure 1:
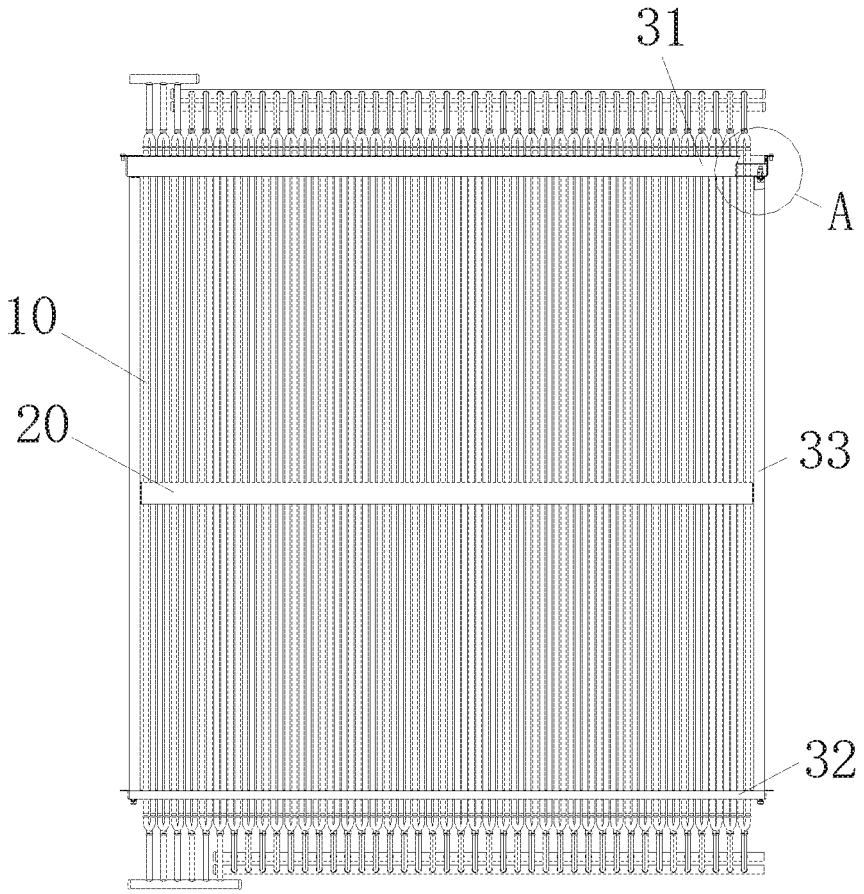
FIG. 1 is a schematic structure diagram of a heat exchanger according to an embodiment of the present disclosure.
Figure 4:
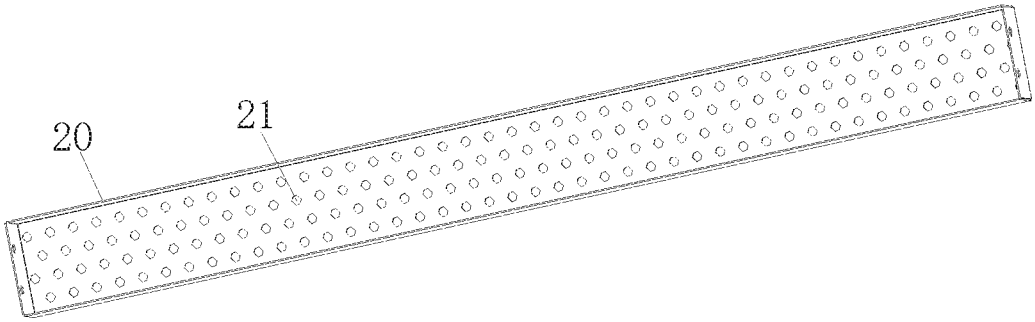
FIG. 4 is a schematic structure diagram of a first water collecting tank of a heat exchanger according to an embodiment of the present disclosure.

As shown in FIGS. 1 and 4, the present disclosure provides a heat exchanger including a heat exchange tube 10 and a first water collecting tank 20. The first water collecting tank 20 is disposed on the heat exchange tube 10. A first water diversion hole 21 is provided at a bottom portion of the first water collecting tank 20. The heat exchange tube 10 passes through the first water diversion hole 21, the first water diversion hole 21 has a diameter greater than an outer diameter of the heat exchange tube 10, and a gap is formed between the first water diversion hole 21 and the heat exchange tube 10. Water flows through the gap and then adheres to an outer wall of the heat exchange tube 10. In the present disclosure, by providing the first water collecting tank 20, and making the heat exchange tube 10 pass through the first water diversion hole 21 provided on the first water collecting tank 20, and leaving a gap therebetween, the water (condensate water or cooling water) in the first water collecting tank 20 evenly flows into the first water diversion hole 21. Since the gap is smaller, the water flow can pass through the gap, then the water flow can further adhere to the heat exchange tube 10 in the first water diversion hole 21 after passing through the gap, which is beneficial to forming a water film on the outer surface of the heat exchange tube 10 and improving the heat exchange efficiency.

When the heat exchanger is a condenser, by providing the first water collecting tank 20, and making the heat exchange tube 10 pass through the first water diversion hole 21 provided on the first water collecting tank 20, and leaving a gap therebetween, the condensate water in the first water collecting tank 20 evenly flows into the first water diversion hole 21. Since the gap is smaller, the water flow can pass through the gap, then the water flow can further adhere to the heat exchange tube 10 in the first water diversion hole 21 after passing through the gap, which is beneficial to forming a water film on the outer surface of the heat exchange tube 10 and improving the heat exchange efficiency.

Figure 3:
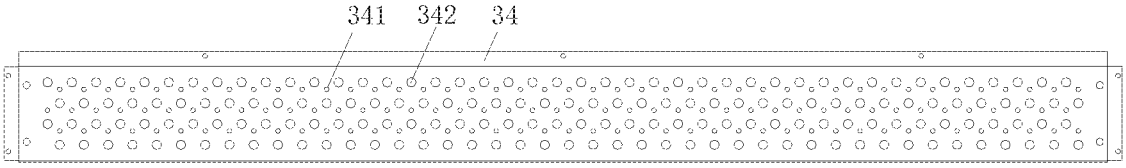
FIG. 3 is a schematic structure diagram of an upper side plate of a heat exchanger according to an embodiment of the present disclosure.

As shown in FIG. 3, in the above embodiment, the heat exchanger further includes an upper side plate 34. The upper side plate 34 is located above the first water collecting tank 20. The upper side plate 34 it provide with a mounting hole 342, and the heat exchange tube 10 expands into the mounting hole. Accordingly, the heat exchange tube 10 which was not fixed can be fixed by the upper side plate 34, to avoid abrasions between the heat exchange tube 10 and its adjacent parts during transportation and operation, eliminating a hidden danger of tube abrasion and ensuring a product quality.

In the above embodiment, the upper side plate 34 is further provided with a drainage structure, and water flows into the first water collecting tank 20 through the drainage structure. The drainage structure has a plurality of drainage holes 341. The drainage holes 341 are provided on the upper side plate 34 at intervals, and one drainage hole 341 is provided between every two adjacent mounting holes 342. The water flow can be evenly distributed into the second water collecting tank 31 through the drainage holes 341.

Figure 6:
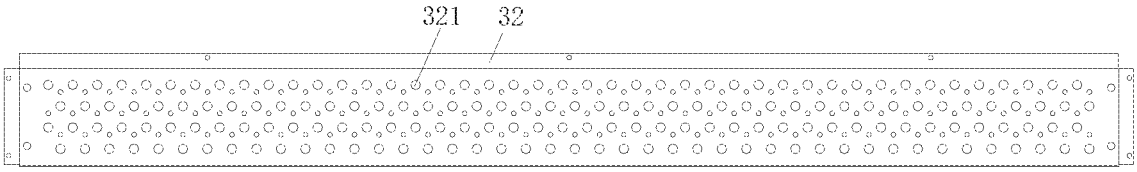
FIG. 6 is a schematic structure diagram of a lower side plate of a heat exchanger according to an embodiment of the present disclosure.

As shown in FIG. 6, in the above embodiment, the heat exchanger further includes an lower side plate 32. The lower side plate 32 is located below the first water collecting tank 20, and a second connection hole 321 is provided on the lower side plate 32. The heat exchange tube 10 expands into the second connection hole 321. By providing the lower side plate 32 which expands into the heat exchange tube 10, the heat exchange tube 10 can be fixed by the lower side plate 32, to avoid abrasions between the heat exchange tube 10 and the lower side plate 32 during transportation and operation, eliminating a hidden danger of tube abrasion and ensuring the product quality.

In the above embodiment, the heat exchanger further includes a connection plate 33. The connection plate 33 is provided between the upper side plate 34 and the lower side plate 32, and two ends of the connection plate 33 are fixed to the upper side plate 34 and the lower side plate 32 respectively. By providing the connection plate 33 to connect the upper side plate 34 with the lower side plate 32 as an integral fixing frame, the overall strength of the heat exchanger can be increased, avoiding damages caused by the abrasions between the heat exchange tube 10 and the water collecting tank, and ensuring the product quality.

In the above embodiment, the heat exchanger further includes a second water collecting tank 31. The second water collecting tank 31 is provided on the heat exchange tube 10 and is located above the first water collecting tank 20. A second water diversion hole 312 is further provided on the second water collecting tank 31, and water flows through the second water diversion hole 312 into the first water collecting tank 20. Since the second water diversion hole 312 is provided in the second water collecting tank 31, the water that previously only flows along a single heat exchange tube 10 converges into the second water collecting tank 31, and then flows through the second water diversion hole 312 into the first water collecting tank 20, to form a first water diversion. After the first water diversion, and after the water converges into the first water collecting tank 20, since the heat exchange tube 10 is provided in each first water diversion hole 21, the water then evenly flows into the first water diversion hole 21 and adheres onto the heat exchange tube 10 to form a second water diversion. Through two water diversions, the water is distributed more evenly, and the amount of condensate water adhering to each heat exchange tube 10 is more even, then a water film formed on the outer surface of the heat exchange tube 10 is more uniform, further improving the heat exchange efficiency.

In the above embodiment, the heat exchange tube 10 passes through the second water diversion hole 312, and the second water diversion hole 312 has a diameter greater than an outer diameter of the heat exchange tube 10, so that a gap is formed between the second water diversion hole 312 and the heat exchange tube 10. Water adheres to an outer wall of the heat exchange tube 10 after passing through the gap. The water (condensate water or cooling water) in the second water collecting tank 31 evenly flows into the second water diversion hole 312. Since the gap is smaller, the water flow can pass through the gap, and then the water flow can adhere to the heat exchange tube 10 in the second water diversion hole 312 after the water flow passes through the gap, which is beneficial to forming a water film on the outer surface of the heat exchange tube 10 and improving the heat exchange efficiency.

Figure 5:
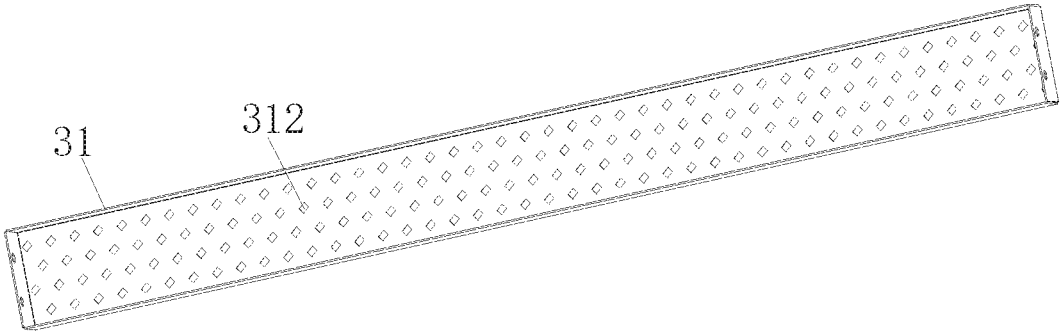
FIG. 5 is a schematic structure diagram of a second water collecting tank of a heat exchanger according to an embodiment of the present disclosure.

As shown in FIG. 5, in the above embodiment, there are a plurality of second water diversion holes 312, and each second water diversion hole 312 is passed through by one heat exchange tube 10. A difference value between a diameter of the second water diversion hole 31 and an outer diameter of the heat exchange tube 10 is in a range of 0.5 mm to 1.5 mm. Accordingly, the water flow can evenly flow into the gap, and the water flow can adhere to the heat exchange tube 10 in the second water diversion hole 312 after flowing into the gap, which is beneficial to forming a water film on the outer surface of the heat exchange tube 10 and improving the heat exchange efficiency.

In the above embodiments, a center of the second water diversion hole 312 is located on an axis of the heat exchange tube 10, so that a uniform gap is formed between outer wall of the heat exchange tube 10 and an inner edge of the second water diversion hole 312, to allow the water to more evenly adhere to the heat exchange tube 10 in the second water diversion hole 312 when the water flows through the gap, which is more beneficial to the formation of a water film on the outer surface of the heat exchange tube 10, improving the heat exchange efficiency.

Figure 2:
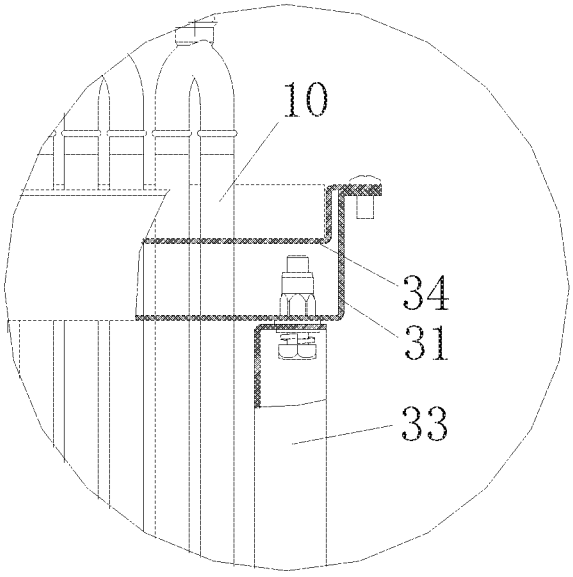
FIG. 2 is a partially enlarged view of A in FIG. 1.

As shown in FIGS. 1 and 2, in the above embodiment, the second water collecting tank 31 is located below the upper side plate 34, the upper side plate 34 covers the second water collecting tank 31, and the heat exchange tube 10 expanding to the upper side plate 34 passes through the second water collecting tank 31, the connection plate 33 is provided between the second water collecting tank 31 and the lower side plate 32, and two ends of the connection plate 33 are fixed to the second water collecting tank 31 and the lower side plate 32 respectively. The first water collecting tank 20 is located between the second water collecting tank 31 and the lower side plate 32, and the first water collecting tank 20 is fixed to the connection plate 33. By providing the connection plate 33 to connect the first water collecting tank 20, the second water collecting tank 31 and the lower side plate 32 as a whole. On one hand, the overall strength of the heat exchanger can be increased, avoiding the damages caused by the abrasions between the heat exchange tube 10 and the water collecting tank, and ensuring the product quality; on the other hand, the problem of uneven distribution of water flow below the pipelines caused by an overlong heat exchange tube 10 can also be avoided, i.e., the water film can be formed on the outer surface of the heat exchange tube even if the pipeline is longer, improving the heat exchange efficiency.

In the above embodiment, a difference value between a diameter of the first water diversion hole 21 and an outer diameter of the heat exchange tube 10 is in a range of 0.5 mm to 1.5 mm. Accordingly, the water flow can flow through the gap, and then can adhere to the heat exchange tube 10 in the second water diversion hole 21, which is beneficial to form a water film on the outer surface of the heat exchange tube 10, improving the heat exchange efficiency.

In the above embodiment, a center of the first water diversion hole 21 is located on an axis of the heat exchange tube 10, so that a uniform gap is formed between an outer wall of the heat exchange tube 10 and an inner edge of the first water diversion hole 21, to allow the water to more evenly adhere to the heat exchange tube 10 in the first water diversion hole 21 when the water flows through the gap, which is more beneficial to the formation of the water film on the outer surface of the heat exchange tube 10, improving the heat exchange efficiency.

In the above embodiment, the heat exchanger further includes a liquid collecting tube and a gas diversion tube. One end of the heat exchange tube 10 is connected to the gas diversion tube, and the other end of the heat exchange tube is connected to the liquid collecting tube.

In another embodiment of the present disclosure, an air conditioner including the above heat exchanger is further provided.

In another embodiment of the present disclosure, a refrigerating unit including the above heat exchanger is further provided.

What is claimed is:

1. A heat exchanger, comprising a heat exchange tube, a first water collecting tank, and a second water collecting tank, the first water collecting tank being provided on the heat exchange tube, a first water diversion hole being provided at a bottom portion of the first water collecting tank, the heat exchange tube passing through the first water diversion hole, and the first water diversion hole having a diameter greater than an outer diameter of the heat exchange tube;

further comprising an upper side plate, a lower side plate, and a connection plate, wherein the upper side plate is located above the first water collecting tank, a plurality of mounting holes are provided on the upper side plate, and the heat exchange tube is fixedly mounted in one of the plurality of mounting holes;

wherein the second water collecting tank being provided on the heat exchange tube and being located above the first water collecting tank and below the upper side plate, a second water diversion hole being further provided on the second water collecting tank, and water flows through the second water diversion hole into the first water collecting tank;

wherein the lower side plate is located below the first water collecting tank, a second connection hole is provided on the lower side plate, and the heat exchange tube is fixedly mounted in the second connection hole;

wherein the connection plate is vertically extended between the upper side plate and the lower side plate and is spaced from the heat exchange tube, and two ends of the connection plate are respectively and physically fixed to the second water collecting tank and the lower side plate;

wherein a drainage structure is further provided on the upper side plate, and water flows through the drainage structure into the first second water collecting tank;

wherein the drainage structure has a plurality of drainage holes;

wherein the plurality of drainage holes are provided on the upper side plate at intervals, and one drainage hole is provided between every two adjacent mounting holes of the plurality of mounting holes.

2. The heat exchanger according to claim 1, wherein the heat exchange tube passes through the second water diversion hole, and the second water diversion hole has a diameter greater than an outer diameter of the heat exchange tube.

3. The heat exchanger according to claim 2, wherein a center of the second water diversion hole is located on an axis of the heat exchange tube.

4. The heat exchanger according to claim 1, wherein the upper side plate covers the second water collecting tank, the first water collecting tank is fixed to the connection plate.

5. The heat exchanger according to claim 1, wherein a center of the first water diversion hole is located on an axis of the heat exchange tube.

6. The heat exchanger according to claim 1, further comprising a liquid collecting tube and a gas diversion tube, one end of the heat exchange tube is connected to the gas diversion tube, and the other end of the heat exchange tube is connected to the liquid collecting tube.

7. An air conditioner, comprising the heat exchanger according to claim 1.

8. A refrigerating unit, comprising the heat exchanger according to claim 1.

* * * * *